US008790082B2

(12) United States Patent
Merrill et al.

(10) Patent No.: US 8,790,082 B2
(45) Date of Patent: Jul. 29, 2014

(54) GAS TURBINE BLADE WITH INTRA-SPAN SNUBBER

(75) Inventors: Gary B. Merrill, Orlando, FL (US); Clinton Mayer, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 453 days.

(21) Appl. No.: 12/848,456

(22) Filed: Aug. 2, 2010

(65) Prior Publication Data

US 2012/0027616 A1 Feb. 2, 2012

(51) Int. Cl.
*F01D 5/22* (2006.01)

(52) U.S. Cl.
USPC ..... 416/96 R

(58) Field of Classification Search
USPC ..... 415/189, 193, 196; 416/96 R, 190
See application file for complete search history.

(56) References Cited

U.S. PATENT DOCUMENTS

| | | | | | |
|---|---|---|---|---|---|
| 937,006 | A * | 10/1909 | McKee | 416/196 R |
| 2,914,299 | A * | 11/1959 | Mitchell | 416/191 |
| 3,055,634 | A * | 9/1962 | Mackenzie | 416/193 R |
| 3,612,718 | A * | 10/1971 | Palfreyman et al. | 416/135 |
| 3,762,210 | A | 10/1973 | White | |
| 4,734,010 | A * | 3/1988 | Battig | 416/196 R |
| 5,052,890 | A | 10/1991 | Roberts | |
| 5,248,241 | A * | 9/1993 | Ortolano et al. | 416/193 R |
| 5,505,250 | A | 4/1996 | Jago | |
| 5,695,323 | A | 12/1997 | Pfeifer et al. | |
| 6,375,420 | B1 | 4/2002 | Tanuma et al. | |
| 6,503,053 | B2 | 1/2003 | Huebner | |
| 6,682,306 | B2 | 1/2004 | Murakami et al. | |
| 6,929,054 | B2 * | 8/2005 | Beals et al. | 164/369 |
| 2008/0145228 | A1 | 6/2008 | Truckenmueller et al. | |
| 2011/0194939 | A1 * | 8/2011 | Marra | 416/196 R |
| 2011/0194943 | A1 * | 8/2011 | Mayer et al. | 416/97 R |

* cited by examiner

*Primary Examiner* — Nathaniel Wiehe
*Assistant Examiner* — Brian O Peters

(57) ABSTRACT

A gas turbine blade (10) including a hollow mid-span snubber (16). The snubber is affixed to the airfoil portion (14) of the blade by a fastener (20) passing through an opening (24) cast into the surface (22) of the blade. The opening is defined during an investment casting process by a ceramic pedestal (38) which is positioned between a ceramic core (32) and a surrounding ceramic casting shell (48). The pedestal provides mechanical support for the ceramic core during both wax and molten metal injection steps of the investment casting process.

4 Claims, 3 Drawing Sheets

GAS TURBINE BLADE WITH INTRA-SPAN SNUBBER

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates generally to the field of gas turbines, and more specifically to the design and manufacturing of large, hollow, gas turbine blades.

BACKGROUND OF THE INVENTION

Gas turbine engines produce power by expanding a hot combustion gas over multiple rows of rotating airfoils, often called blades, attached at their respective roots to a rotating shaft. Such blades are often cast from a superalloy material and may be coated with a ceramic thermal barrier coating material in order to survive the high temperature, highly corrosive combustion gas environment.

As the power levels of land-based electrical power generating gas turbine engines increase, the size of the rotating blades of such engines continues to increase, and the stresses imposed on the root attachment of the blades becomes a limiting design consideration. Additionally, longer blades are more prone to stall flutter under adverse aerodynamic conditions. It is known to include mid-span snubbers to provide a mechanical connection between adjacent blades in order to increase the stiffness of the blades, thereby making them more resistant to stall flutter. However, the additional weight of the snubber exacerbates the mechanical loads in the root attachment region.

The manufacturing of ever-longer gas turbine blades is also challenging the limits of known investment casting techniques. In particular, the ceramic cores used to define the internal cooling passages of cast gas turbine blades in the investment casting process are known to be relatively fragile and prone to damage during the wax and molten metal casting process steps. U.S. Pat. No. 5,505,250 discloses the use of platinum chaplets inserted into and extending from a surface of a ceramic core to provide point contact with a die surrounding the ceramic core during the molten metal injection step. The platinum chaplets dissolve in the molten metal, but they provide at least some support to the core during both the wax and metal injection steps, and they leave the outside cast surface of the metal smooth with no external penetration or void in the cast metal wall at the locations of the chaplets. However, the addition of the dissolved chaplet material into the molten cast metal may be undesirable for some alloys, and the innermost ends of the chaplets that are inserted into the ceramic core remain in the final cast product as an obstruction in the cooling passageway defined by the core.

Thus, improved designs and manufacturing techniques are needed in order to support the ongoing increase in size of gas turbine engine blades.

BRIEF DESCRIPTION OF THE DRAWINGS

The invention is explained in the following description in view of the drawings that show.

DETAILED DESCRIPTION OF THE INVENTION

Mid-span snubbers have been used on both steam turbine blades (U.S. Pat. No. 6,682,306) and gas turbine blades (U.S. Pat. No. 5,695,323). Such snubbers are known to be integrally cast or forged with the blade airfoil, and thus are solid and add a significant amount of weight to the rotating mass of the airfoil. The present inventors have recognized that the blade lengths that will be necessary for future designs of ever more highly powered gas turbine engines will necessitate a different design and manufacturing approach for blades and snubbers.

Accordingly, the present inventors have innovatively developed a blade/snubber design and an associated manufacturing process which not only solve the problem of overly heavy snubbers, but also solve the problem of damage to fragile ceramic cores during the wax and molten metal injection steps of the lost wax investment casting process used to manufacture such blades.

Figure 1:
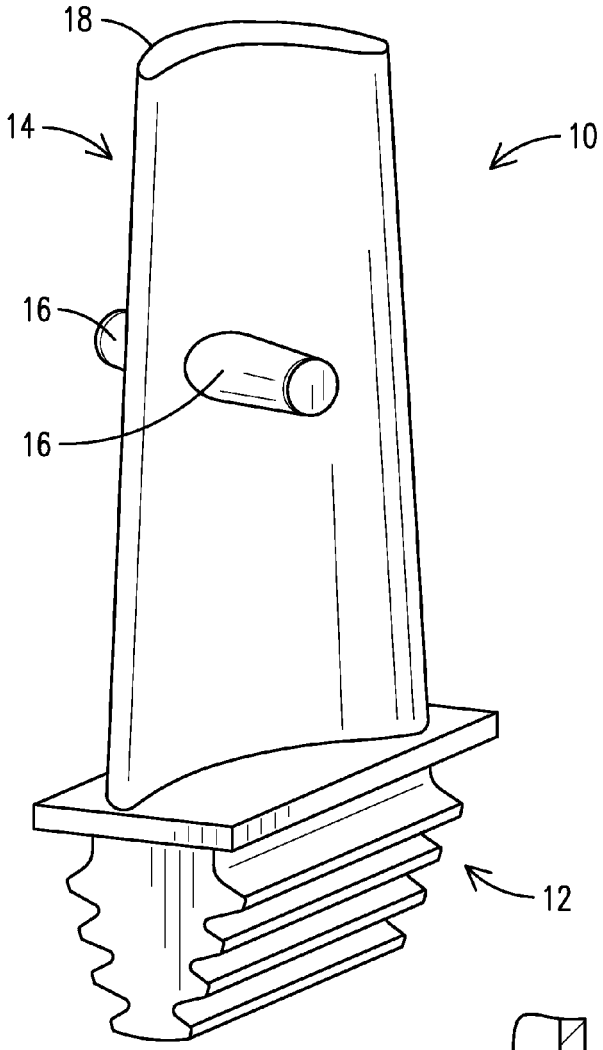
FIG. 1 is a perspective view of a gas turbine blade in accordance with an embodiment of the invention.
Figure 2:
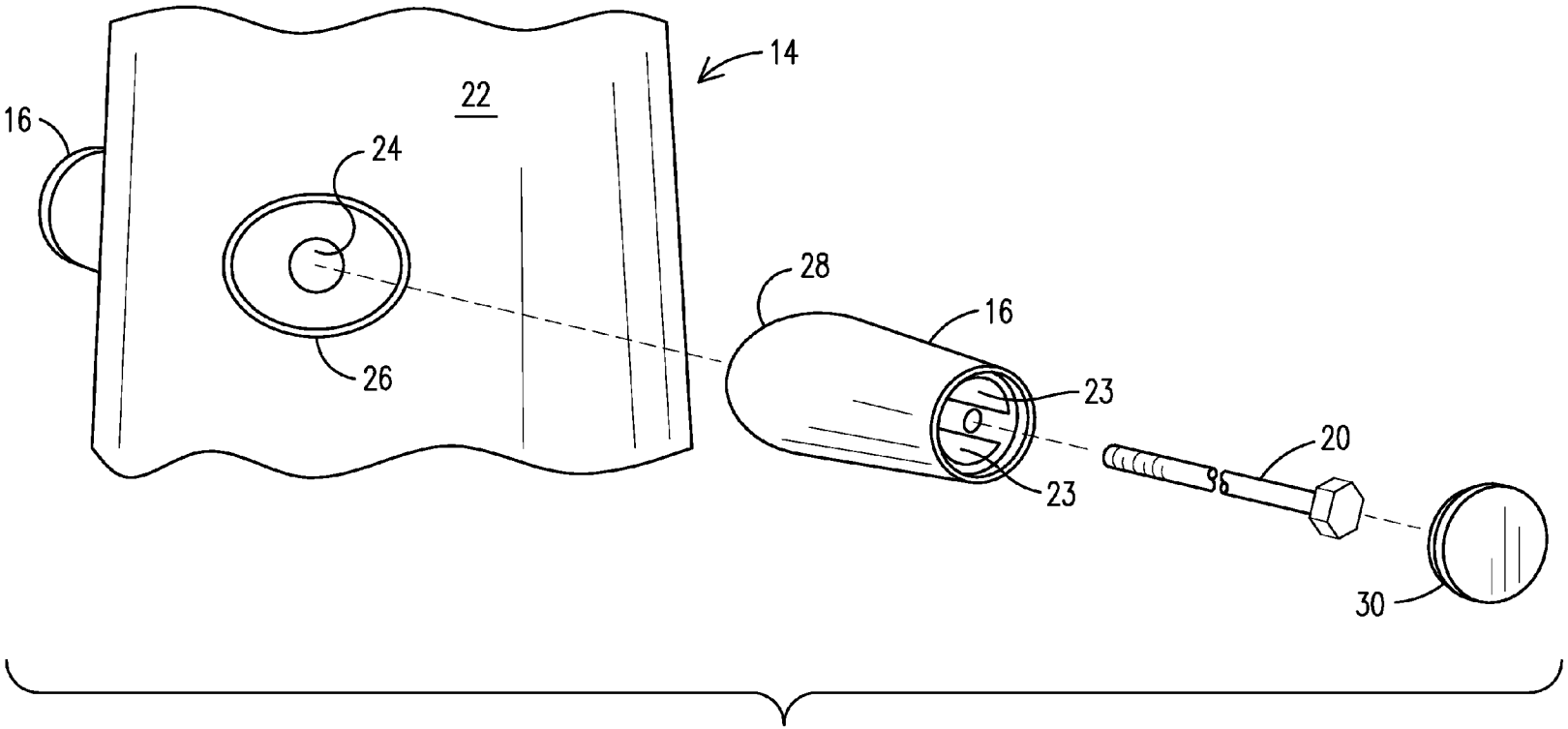
FIG. 2 is a partial exploded sectional view of the blade of FIG. 1.

A gas turbine blade 10 in accordance with an embodiment of the present invention is illustrated in FIG. 1. The blade 10 includes a root portion 12 and an airfoil portion 14. As is well known in the art, the airfoil portion 14 may include one or a plurality of hollow interior cooling passageways that are used to convey a cooling fluid to maintain a desired temperature in the material of the airfoil portion 14 during operation of the blade 10 in a hot combustion gas environment during operation of the gas turbine. A snubber 16 is attached to the airfoil portion 14 at an intra-span position along a chord length which runs in a radial direction from the root portion 12 to the tip 18 of the blade in order to increase the stiffness of the blade 10, thereby making it resistant to stall flutter. FIG. 2 is a view of the blade 10 showing the airfoil section 14, a sectioned portion of the snubber 16 and a fastener 20 used to affix the snubber 16 to the airfoil portion 14. The view of FIG. 2 reveals that the snubber 16 is not of solid construction but includes a hollow portion 23 receiving the fastener 20. The fastener 20 engages the snubber 16 and passes through an opening 24 formed in the exterior surface 22 of the airfoil portion 14 to engage a cooperating structure (not shown) of the airfoil portion 14 to urge the snubber 16 over the opening 24 and against the exterior surface 22 of the airfoil section 14. Because the opening 24 is in fluid communication between the hollow interior of the airfoil portion 14 and the hollow interior of the snubber 16, the snubber 16 may be hermetically sealed to the airfoil portion 14 in order to prevent leakage of cooling fluid out of the blade 10. The snubber 16 may be brazed to the airfoil portion 14 or it may be otherwise bonded, such as with diffusion bonding or transient liquid phase bonding, in lieu of or in addition to the use of the fastener 20. In one embodiment, a geometric feature 26, such as a groove, may be formed in the exterior surface 22 of the airfoil portion 14 about the opening 24, and an end 28 of the snubber 16 may be shaped to engage the geometric feature 26 to ensure proper positioning and to aid in creating a seal over the opening 24. Because the snubber 16 is at least partially hollow, its weight may be less than the weight of a similar snubber of the prior art. The end of the snubber 16 most remote from the airfoil section may be closed or it may be open to provide access to the fastener 20, with such an open end being closed with a cover plate 30 or weld buildup after the snubber 16 is affixed to the airfoil portion 14 with the fastener 20.

Figure 3:
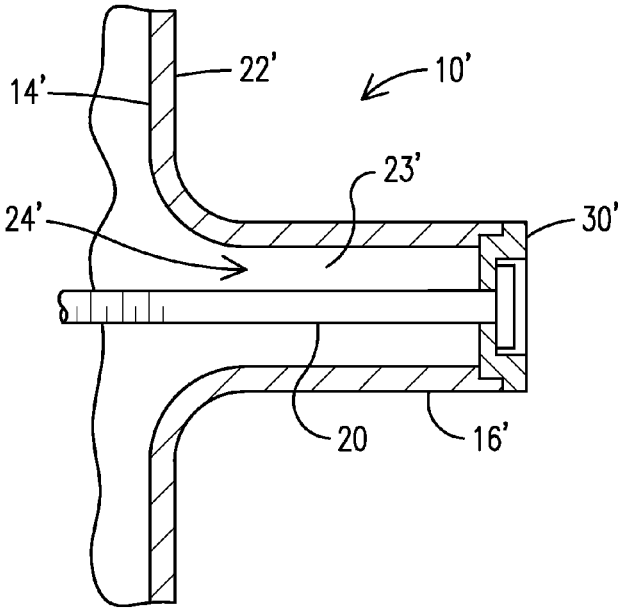
FIG. 3 is a partial cross-sectional view of an alternative embodiment of a gas turbine blade in accordance with an embodiment of the invention.

FIG. 3 is a partial cross-sectional view of an alternative embodiment of an airfoil 10' including an airfoil portion 14' having an opening 24' formed in a exterior surface 22', and a snubber 16' attached to the airfoil portion 14' and disposed over the opening 24'. In this embodiment, the snubber 16' is integrally cast with the airfoil portion 14'. The opening 24' extends through the snubber 16' to define the hollow portion 23' of the snubber 16'. A seal plate 30' may be affixed over the open end of the hollow portion 23' such as by welding and/or the use of a fastener 20' passing through the opening 24' to engage a cooperating structure (not shown) of the airfoil portion 14'.

Figure 4:
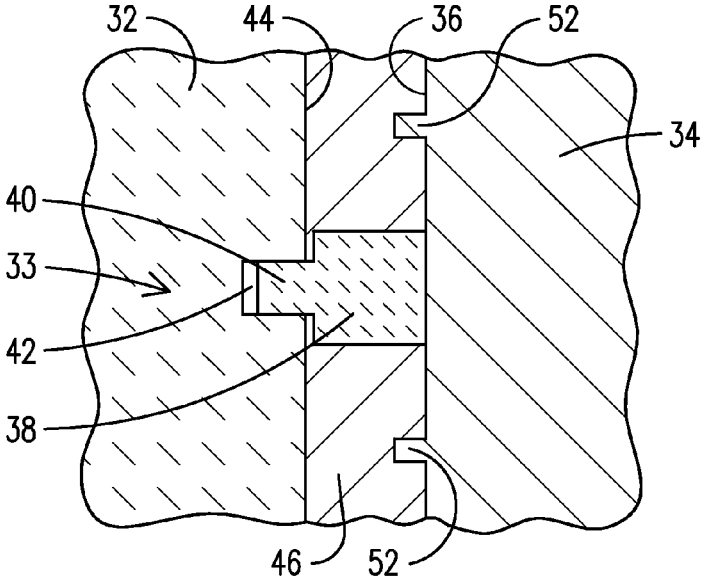
FIG. 4 is a partial cross-sectional view of a ceramic core positioned within a wax mold die with an interposed pedestal providing support for the core.
Figure 5:
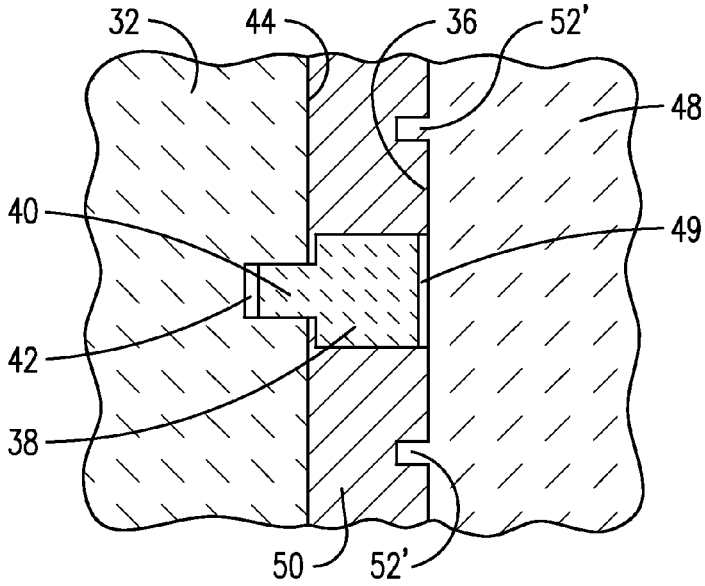
FIG. 5 is the ceramic core and pedestal of FIG. 4 disposed within a ceramic shell during a later stage of blade fabrication.
Figure 6:
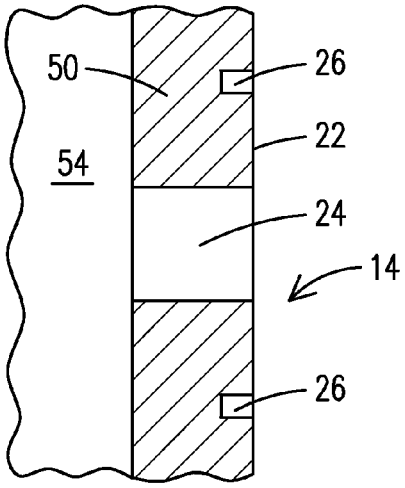
FIG. 6 is a partial cross-sectional view of a gas turbine blade resulting from the casting steps illustrated in FIGS. 4 and 5.

An exemplary method used for manufacturing the gas turbine of FIG. 1 is illustrated in FIGS. 4-6. A ceramic core 32 is first positioned within a wax mold die 34. The ceramic core 32 has a generally radially extending portion 33 defining the shape of a hollow interior cooling passageway to be formed in the subsequently cast gas turbine blade 10, and the surface 36 of the wax mold die 34 defines a shape of the airfoil portion 14 of the blade 10. A ceramic pedestal 38 is positioned in a mid-span region of the core 32 at a location where a snubber 16 is desired in the blade 10. The pedestal 38 may have an end 40 inserted into an indentation 42 formed in an outside surface 44 of the core 32, and may extend from the core 32 to make contact with the surrounding wax mold die 34. The pedestal may be integrally formed with the core 32 to extend from a radially extending portion of the core, or it may be manufactured separately of the same or different material than the radially extending portion of the core. The ceramic core 32 and pedestal 38 may be sintered together to affix the indentation 42 onto the end 40 of the pedestal 38. Wax 46 is then injected into the space between the core surface 44 and the die surface 36 around the pedestal 38. Once the wax solidifies, the wax mold dies 34 is removed, and a ceramic shell 48 is formed in its place as shown in FIG. 5, such as by a known dipping process. Optionally, a fugitive coating 49, such as wax, may be applied to the exposed surface of the pedestal 38 prior to the dipping process so that the ceramic shell 48 remains disconnected from the pedestal 38 in order to allow uninhibited differential movement there between, although in some embodiments, it may be desired to allow the shell 48 to attach to the pedestal 38. The assembly is then heated to fire the ceramic shell 48 and to melt out the wax 46 (and optionally wax 49), leaving a volume for receiving molten metal alloy 50 in a metal injection step. Note that the ceramic pedestal 38 provides mechanical support for the ceramic core 32 during both the wax and molten metal injection steps. Furthermore, unlike the process of prior U.S. Pat. No. 5,505,250, the ceramic material of the pedestal 38 does not dissolve during the metal injection step and therefore contributes no undesirable additions to the metal melt. At this stage of manufacturing, the blade 10 exists as a combination of the metal root portion 12 and airfoil portion 14 along with the ceramic core 32 and ceramic pedestal 38, surrounded by the shell 48.

Once the metal alloy 50 has solidified, the ceramic core 32, pedestal 38 and shell 48 are removed by known mechanical and/or chemical processes to reveal the cast blade airfoil portion 14 containing the opening 24, as shown in FIG. 6 and as previously described with regard to FIG. 2. The opening 24 is in communication with the hollow interior region 54 of the blade 10 that exists in the volume where the ceramic core 32 was previously located. One will appreciate that the geometric feature 26 of FIG. 2 may be formed during this same process by forming a protrusion 52 on the surface 36 of the wax mold die 34. Protrusion 52 will be translated through the wax 46 as a protrusion 52' on the ceramic shell 48 to become the geometric feature 26 on the exterior surface 22 of the airfoil portion 14.

The selection of a ceramic material for forming the pedestal 38 provides several advantages over the prior art. First, the pedestal 38 may be formed of a material which is mechanically stronger than the rather fragile ceramic core material, for example, the same composition as the ceramic core but of a higher density (lower porosity), or another ceramic material such as alumina or sapphire, Second, the ceramic pedestal material will not melt or dissolve during the wax or metal injection steps, therefore maintaining a desired purity of the melt material and ensuring that it provides mechanical support for the core 32 throughout the entire injection process. The ceramic pedestal 38 also defines an opening 24 in the exterior surface 22 of the as-cast airfoil portion 14 which is in fluid communication with the hollow interior region of the blade 10 defined by the ceramic core 32, without the need for any post-casting drilling or material removal step. That opening 24 is advantageously utilized in the blade 10 of FIG. 1 for passage of a fastener 20 for affixing the snubber 16 to the airfoil portion 14.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A blade for a gas turbine engine comprising:

a root portion;

an airfoil portion extending from the root portion and a snubber, the airfoil portion comprising a hollow interior region and the snubber attached to the airfoil portion, wherein an opening is formed in an exterior surface of the airfoil portion and in communication with the hollow interior region, and the snubber is disposed over the opening;

further comprising a fastener disposed through the opening and which positions the snubber against the airfoil portion.

2. The blade of claim 1, wherein the snubber comprises a hollow portion.

3. A blade for a gas turbine engine, comprising:

a root portion;

an airfoil portion extending from the root portion, the airfoil portion comprising a hollow interior region;

an opening formed in an exterior surface of the airfoil portion and in communication with the hollow interior region;

a snubber attached to the airfoil portion and disposed over the opening; and a groove formed in the exterior surface of the airfoil portion about the opening, with an arrangement wherein an end of the snubber is cooperatively shaped and positioned to engage the groove to aid in creating a seal over the opening.

4. The blade of claim 3, wherein the snubber comprises a hollow portion.

* * * * *